US006881164B2

(12) United States Patent
Gilligan et al.

(10) Patent No.: US 6,881,164 B2
(45) Date of Patent: Apr. 19, 2005

(54) SPORTS EQUIPMENT AND/OR TOOL HANDLE GRIP

(75) Inventors: Lawrence J. Gilligan, Ringwood, NJ (US); Joseph Gilligan, IV, Ringwood, NJ (US)

(73) Assignee: Akadema Inc., Garfield, NJ (US)

( * ) Notice: Subject to any disclaimer, the term of this patent is extended or adjusted under 35 U.S.C. 154(b) by 0 days.

(21) Appl. No.: 10/306,608

(22) Filed: Nov. 27, 2002

(65) Prior Publication Data

US 2004/0102264 A1 May 27, 2004

(51) Int. Cl.[7] ..... A63B 59/06
(52) U.S. Cl. ..... 473/568; 81/489
(58) Field of Search ..... 473/568, 300, 473/549; 81/489

(56) References Cited

U.S. PATENT DOCUMENTS

| | | | | | |
|---|---|---|---|---|---|
| 300,360 | A | * | 6/1884 | Gray | 473/568 |
| 1,293,949 | A | | 2/1919 | Sellers et al. | |
| 1,860,561 | A | * | 5/1932 | Warner | 81/489 |
| 2,101,714 | A | * | 12/1937 | Keeney | 427/341 |
| 2,115,119 | A | | 4/1938 | Park | |
| 2,583,198 | A | * | 1/1952 | Axton, Jr. | 473/549 |
| 2,804,400 | A | * | 8/1957 | Kelly et al. | 473/568 |
| 3,433,481 | A | | 3/1969 | Tanguay | |
| 4,012,039 | A | | 3/1977 | Yerke | |
| 4,284,275 | A | * | 8/1981 | Fletcher | 473/549 |
| 5,234,740 | A | | 8/1993 | Reeves et al. | |
| 5,475,894 | A | * | 12/1995 | Wildforster | 16/430 |
| 5,686,158 | A | * | 11/1997 | Gibbon | 428/36.92 |
| 5,730,662 | A | | 3/1998 | Rens | |
| 5,851,632 | A | | 12/1998 | Chen et al. | |
| 6,036,610 | A | | 3/2000 | Lewark | |
| 6,234,920 | B1 | * | 5/2001 | Wang | 473/523 |
| 6,372,323 | B1 | | 4/2002 | Kobe et al. | |
| 6,461,260 | B1 | | 10/2002 | Higginbotham | |

* cited by examiner

*Primary Examiner*—Mark S. Graham
(74) *Attorney, Agent, or Firm*—Kaplan & Gilman, LLP

(57) ABSTRACT

A grip for sports equipment and/or tools is provided. The grip, which is applied to the handle portion of sports equipment and/or tools, comprises a slurry of gripping material, which itself comprises various mixtures of gripping particles mixed into the binding fluid in quantities that are proportional to the starting quantity of the binding fluid and in proportion to the quantities of other gripping particles mixed into the binding fluid. The handle portion of the sports equipment and/or tool is dipped into the slurry of gripping material, the sports equipment and/or tool is then removed and the slurry of gripping material is allowed to adhere around the handle thereby becoming an integral part of the handle which is not removable, or apt to peel off, not sticky and which does not need to be reapplied before each use.

44 Claims, 3 Drawing Sheets

SPORTS EQUIPMENT AND/OR TOOL HANDLE GRIP

BACKGROUND OF THE INVENTION

This invention relates to the field of items that are held by users and have handles for gripping, such as sports equipment and tools, and more particularly, to a baseball bat handle grip.

Baseball bats are as old as the game itself. In fact, other than possible dimensions and/or weights of bats over the years, the baseball bat has probably not changed much since the first bat used when the game was invented; at least when considering wooden baseball bats, as opposed to the newer metal baseball bats.

It has always been the case for the newer metal baseball bats that they have some type of grip element applied to the handle portion of the bat to allow for better hand gripping of the smooth and slippery metal surface of the handle of the bat, and also to help reduce the shock/impact effect of the ball hitting the bat on the user's hands. In most instances, the gripping elements applied to metal bats have consisted of some type of a rubber or possibly even leather cover that is applied at least over the handle of the bat, and in many instances also over the knob at the end of the bat. These gripping covers usually have a "cushy" feel to them, which allows for better gripping and also cushioning of the user's hands.

To the contrary, however, there has been very little, if anything, done regarding the handles of wooden bats over the history of baseball. While we all remember at one point purchasing a wooden bat when we were kids which had a strip of cloth wrapped around the handle portion of the bat, this is the extent to which "permanent" gripping elements have been applied to wooden bats. Non-permanent gripping elements such as pine tar is often rubbed onto the handle of the bat by a baseball player just prior to the player taking his position at home plate to bat. Players also use batting gloves as a means of having a better grip on a bat and cushioning the blow of the ball against the bat.

Accordingly, while the manners of gripping a metal bat have advanced, and are readily seen on metal bats today in the form of rubberized covers applied to the handle area of the bat, none of the prior art regarding the application of similar type coverings to wooden handled bats has had much success in the market place. Examples are as follows:

U.S. Pat. No. 3,433,481, issued on Mar. 18, 1969 to Tanguay, entitled Baseball Bat Wrappings, is directed to a manner of reinforcing a handle of a wooden baseball bat through the use of wrappings. While an additional gripping advantage is also achieved in the '481 patent, the manner of the gripping element is distinctly different from that of the subject invention. In the two embodiments covered in the '481 patent, the handle of the bat is wrapped with two layers of wrapping material prior to application of the layer containing the gripping elements. In the first embodiment of the '481 patent, two pressure sensitive tapes reinforced with high tensile strands are wrapped side by side on the upper portion of the bat handle and then one of the tapes is extended down to the knob while the other tape is then continued after a layer of the gripping material is applied, so that the gripping material is applied over the first taping and then is intermittently overlapped by the second tape, which is then continued down to the knob area of the bat. In the second embodiment of the '481 patent, a layer of neoprene is applied over the handle of the bat and then a tape layer is overlappingly wound around the bat handle, covering the neoprene layer. It is only after the tape is applied over the neoprene layer that the gripping layer is applied on top of the tape. Accordingly, it is seen that for a wooden bat, the '481 patent does not teach that a gripping material as described in that patent can be applied directly onto the handle of the wooden bat, but must instead be applied over at least one pre-applied tape element in order for it to achieve the results of the invention.

U.S. Pat. No. 1,293,949, issued Feb. 11, 1919 to Sellars, entitled Coating Material for Handles of Sporting and Trade Implements and Method of Applying Same, is directed to the application of such a coating material to either a wood or a metal surface. However, in the case of the '949 patent, the coating materials being applied are combinations of gutta percha and balata. As these materials are more along the lines of a rubber/latex type covering, the '949 patent is more akin to the rubberized cover we see today on metal bats.

U.S. Pat. No. 4,012,039, issued Mar. 14, 1977 to Yerke, entitled Permanent Form-Fitting, Non-Slip Cover for Hand Gripping Portion of Baseball Bat, Golf Clubs and the Like, is clearly distinct from the subject invention, as it is directed to the application of a synthetic fiber material over the handle of the bat. This slip-resistant covering is applied using epoxy or some other similar type glue based material.

Accordingly, while each of the above patents possible achieve a better grip on a baseball bat, all require that some form of a base material be either wrapped around the handle or applied onto the handle in the form of a rubbery type, latex material. It would be desirable to overcome the limitations of these inventions by providing a grip coating for sports equipment and/or tools, and preferably for a wooden baseball bat, which does not first require the application of tapes or rubberized materials to the bat handle and instead simply consist of a thin layer of a slurry material having gripping particles mixed therein which when it adheres to the handle of the bat, creates a grip surface which is permanent and does not need to be reapplied by the player/user prior to each use.

SUMMARY OF THE INVENTION

In accordance with the invention, a grip for sports equipment and/or tools, is provided. The grip, which is applied to the handle portion of sports equipment and/or tools, comprises a slurry of gripping material, which itself comprises various mixtures of gripping particles mixed into the binding fluid in quantities that are proportional to the starting quantity of the binding fluid and in proportion to the quantities of other gripping particles mixed into the binding fluid. The handle portion of the sports equipment and/or tool is dipped into the slurry of gripping material, the sports equipment and/or tool is then removed and the slurry of gripping material is allowed to adhere around the handle thereby becoming an integral part of the handle which is not removable, or apt to peel off, not sticky and which does not need to be reapplied before each use.

Accordingly, it is an object of the invention to provide an improved grip for sports equipment and/or tools.

Still another object of the invention is to provide an improved grip for sports equipment and/or tools that is not applied over any other taping or rubberized gripping element but is instead applied directly to the handle of the sports equipment and/or tools.

Yet another object of the invention is to provide an improved grip for sports equipment and/or tools that while providing for a better grip to the user, is not overly harsh to the user's hands and so provides both a comfortable grip and a secure grip.

Other objects of the invention will in part the obvious and will in part be apparent from the following description.

BRIEF DESCRIPTION OF THE DRAWINGS

For a full understanding of the invention, reference is made to the following description, taken in accordance with the accompanying drawings, in which.

DETAILED DESCRIPTION OF THE PREFERRED EMBODIMENTS

Figure 1:
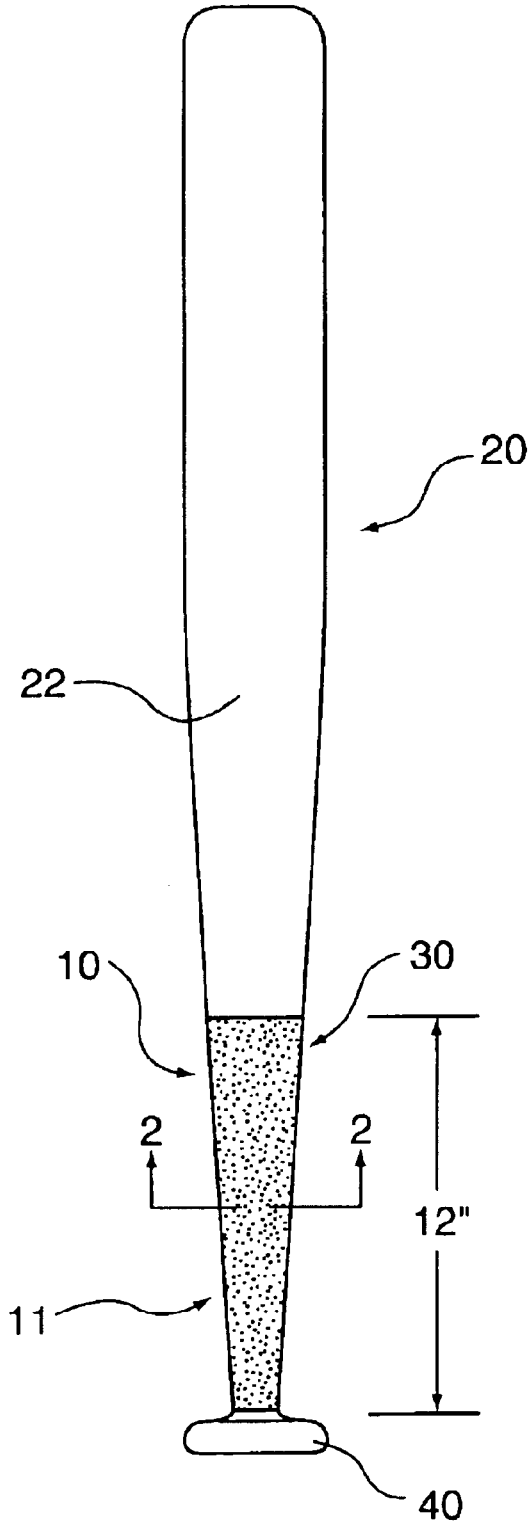
FIG. 1 is a side elevational view of a baseball bat showing the application of the inventive slurry.

Referring to the figures, a grip for sports equipment and/or tools made in accordance with the subject invention is shown at 10. Grip 10 consists of a slurry 11 applied to bat 20 along handle portion 30. Slurry 11 is applied to handle 30 between knob 40 and a position approximately 12 inches from knob 40 extending in the direction of hitting area 22 of bat 20.

Figure 2:
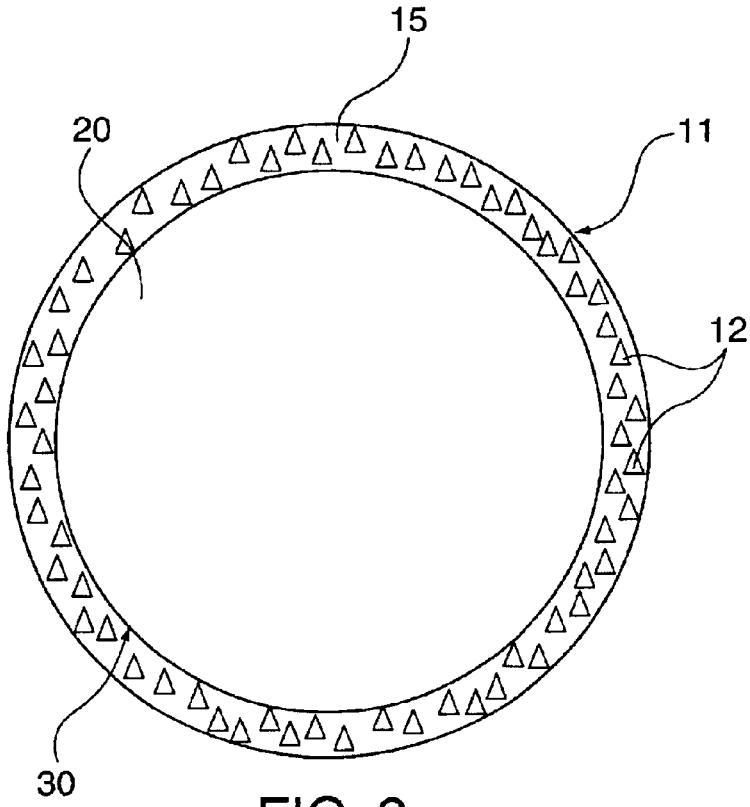
FIG. 2 is a cross-sectional view taken along line 2—2 of FIG. 1.

In the broadest embodiment of the subject invention (shown in FIG. 2), slurry 11 could consist of binding fluid 15 into which is mixed first gripping particles 12. First gripping particles 12 comprise powdery talc. Powdery talc particles 12 are shown in FIG. 2 as triangular elements.

Figure 3:
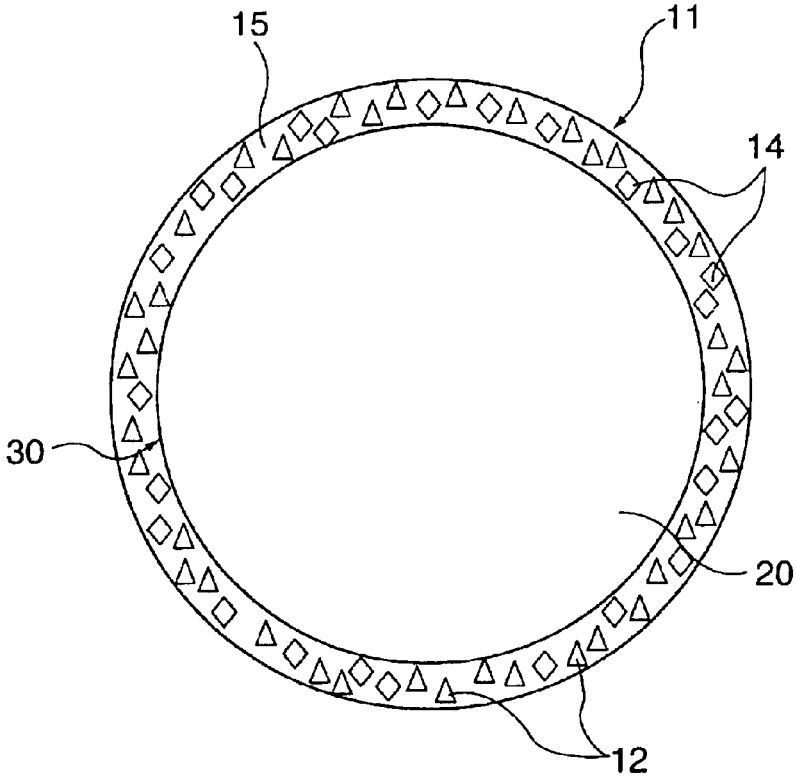
FIG. 3 is an alternate cross-sectional view taken along line 2—2 of FIG. 1, showing another embodiment of the inventive slurry.

Another preferred embodiment of the invention (shown in FIG. 3), creates slurry 11 from binding fluid 15 and a mixture of first and second gripping particles; powdery talc 12 and sand/quartz 14. As in FIG. 2, powdery talc 12 is shown in FIG. 3 as triangular elements, while sand/quartz 14 is shown in FIG. 3 as diamond shaped elements.

Figure 4:
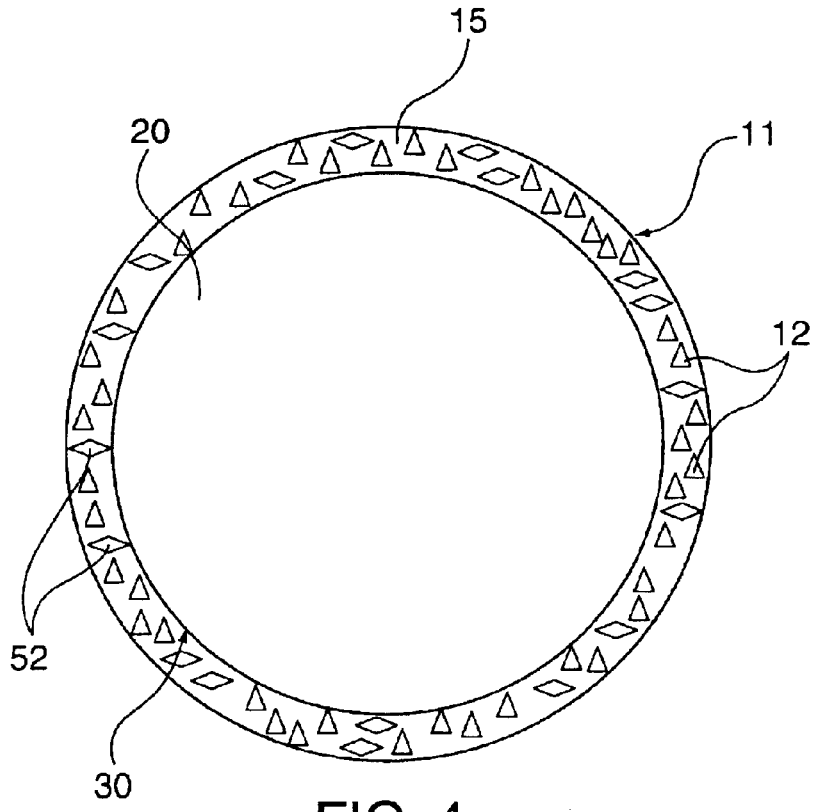
FIG. 4 is yet another alternate cross-sectional view taken along line 2—2 of FIG. 1, showing yet another embodiment of the inventive slurry.

In yet another preferred embodiment of the invention (shown in FIG. 4), binding fluid 15 is combined with both powdery talc 12 and a granular talc 52, with granular talc 52 taking the place of sand 14 in slurry 11. Granular talc 52 is shown as diamond shaped in FIG. 4. Essentially, and as stated above, while powdery talc could itself be used to make slurry 11 and thereby achieve the invention of a grip of sports equipment and/or tools, using sand 14 or granular talc 52 provides an even better gripping surface. However, too much sand 12 or granular talc 52 will cause grip 10 to be too harsh/rough on the hands of the user of bat 20, and accordingly, a balanced formulation between powdery talc 12 and either sand 14 or granular talc 52 is needed. By reaching the correct balance between these elements, the peaks and valleys created by the more granular materials (sand and granular talc), is smoothed over by the powdery talc, and hence a more pleasing, yet equally effective, gripping surface is produced.

Figure 5:
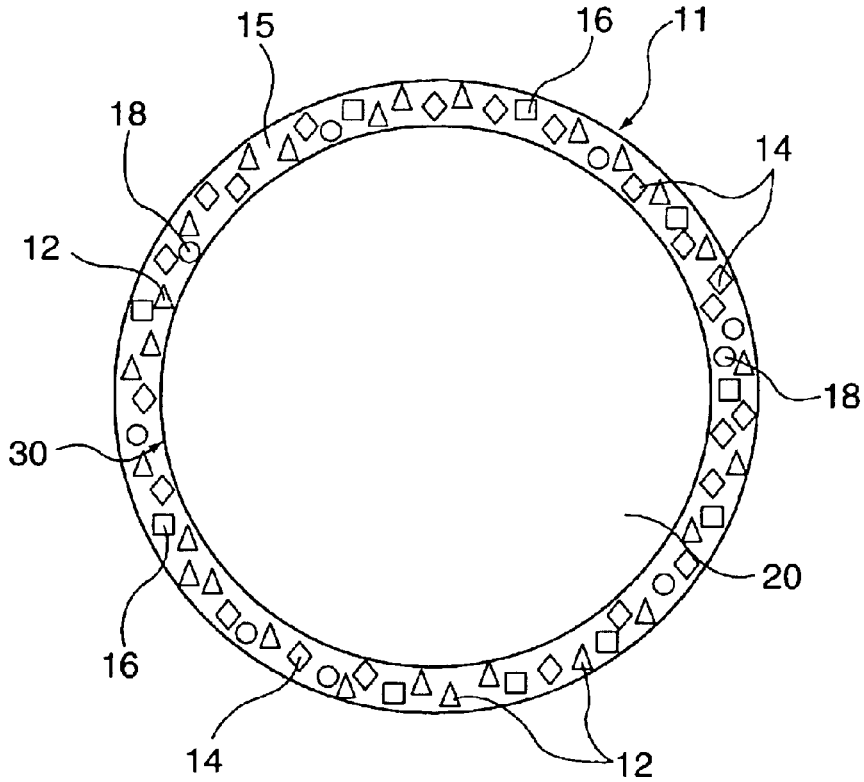
FIG. 5 is still another alternate cross-sectional view taken along line 2—2 of FIG. 1, showing still another embodiment of the inventive slurry.

In addition to the use of powdery talc 12, other elements can be mixed into binding fluid 15 to make slurry 11 feel more comfortable/less rough to the hands of a user of bat 20. These other elements include crushed walnut shells 16 and crushed sunflower seed shells 18. These shells 16 and 18 are shown mixed in with both sand 14 and powdery talc 12, in FIG. 5, and are represented therein by the squares and circles, respectively.

Binding fluid 15 is preferably industrial finish enamel flat paint, which is used because it has the attributes that it provides not only a means of coloring the handle of bat 20, to either match the color (usually black) of the rest of the bat, but because it has the other useful properties: such as (1) drying without becoming sticky; (2) being readily adherable to a wooden structure, such as a wooden baseball bat; and (3) not being a movable structure, such as the tapes and/or rubber coverings of the prior art. Accordingly, binding fluid 15 provides a material into which the gripping particles can be mixed, which fluid is able to adhere in a permanent, non-moving, non-sticky manner to handle 30 of bat 20. It is understood from the invention that any other material which imparts the same properties, is anticipated as being able to be used instead of the enamel flat paint of the preferred embodiments.

No matter which embodiment is being discussed, the overall proportion of gripping particles to binding fluid is approximately 46.7 ounces of gripping particles to every one gallon of binding fluid. Accordingly, when, in the first embodiment, there is only the first gripping particle being used, powdery talc, all of the approximate 46.7 ounces of gripping particles is the powdery talc. However, as the other gripping particles are also added into the slurry, the proportion of powdery talc is reduced, while the proportion of the other gripping particles are increased. As such, when there are both first and second gripping particles in the slurry, powdery talc (the first gripping particle) is at 44 ounces, while either sand/quartz or granular talc (the possible alternative second gripping particles) are at ⅓ of a cup (which it is believed equates to 2.7 ounces, thus arriving at the 46.7 number. Should it be determined that ⅓ of a cup is not 2.7 ounces, the controlling quantity is ⅓ of a cup, not 2.7 ounces. This holds true throughout the remaining proportion calculations). Further, when the slurry consists of first, second and third gripping particles, powdery talc is at 38 ounces, sand/quartz is at 2.7 ounces and crushed walnut shells (the third gripping particle) is at 6 ounces. Finally, when the slurry consists of first, second, third and fourth gripping particles, powdery talc is at 37 ounces, sand/quartz is at 2.7 ounces, crushed walnut shells is at 6 ounces and crushed sunflower seeds (the fourth gripping particle) is at 1 ounce. As is seen, the total ounces of gripping particles to binding fluid is 46.7 ounces to every one gallon of binding fluid.

Talc, or as it is known in chemistry, Magnesium Silicate Hydroxide ($Mg_3Si_4O_{10}(OH)_2$), is in the silicate class and is often used in paint as a filler. Talc may be best known to the ordinary consumer as the primary ingredient in talcum powder. Accordingly, while talc and paint have had a long history of working together, never before has the combination of these elements been used, either alone, or with other gripping particles, as an enhanced grip for sports equipment and/or tools, and certainly not as a gripping composition for a baseball bat that is applied directly onto the wood of the bat.

It will thus be seen that the objects set forth above, among those made apparent from the preceding description, are efficiently obtained, and, since certain changes may be made in the above constructions without departing from the spirit and scope of the invention, it is intended that all matter contained in the above description and shown in the accompanying drawings shall be interpreted as illustrative, and not in a limiting sense.

It is also to be understood that the following claims are intended to cover all of the generic and specific features of the invention herein described and all statements of the scope of the invention, which, as a matter of language, might be said to fall therebetween.

What is claimed is:

1. A grip for a handle of sports equipment and/or tools, comprising:

a slurry of gripping material applied directly onto said handle of said sports equipment and/or said tool, comprising:

a quantity "a" of a binding fluid; and a quantity "b" of first gripping particles mixed into said binding fluid, wherein said quantity "b" of said first gripping particles is in a fixed proportion to said quantity "a" of said binding fluid wherein said quantity "b" of said first gripping particles is 46.7 ounces when said quantity "a" of said binding fluid is 1 gallon.

2. A grip for sports equipment and/or tools as recited in claim 1, wherein said binding fluid is paint.

3. A grip for sports equipment and/or tools as recited in claim 2, wherein said paint is industrial finish enamel flat paint.

4. A grip for sports equipment and/or tools as recited in claim 2, wherein said first gripping particles are powdery talc.

5. A grip for sports equipment and/or tools as recited in claim 1, wherein said sports equipment is a baseball bat comprising a knob at a first end of said bat opposite a ball hitting end of said bat, and further wherein said handle is located between said knob and said ball hitting end of said bat, said slurry of gripping material being applied to a circumferential area of said handle between said knob and a position along said handle toward said ball hitting end approximately 12 inches from said knob.

6. A grip for sports equipment and/or tools as recited in claim 5, wherein said bat is made of wood.

7. A grip for a handle of sports equipment and/or tools comprising:

a slurry of gripping material applied directly onto said handle of said sports equipment and/or said tool, comprising:

a quantity "a" of a binding fluid;

a quantity "b" of first griping particles mixed into said binding fluid; and a quantity "c" of second gripping particles mixed into said binding fluid; wherein said quantities "b" and "c" of said first and second gripping particles are in a fixed proportion to said quantity "a" of said binding fluid and to each other, wherein said quantity "b" of said first gripping particles is 44 ounces when said quantity "a" of said binding fluid is 1 gallon and said quantity "c" of said second gripping particles is ⅓ of a cup (or 2.7 ounces).

8. A grip for sports equipment and/or tools as recited in claim 7, wherein said binding fluid is paint.

9. A grip for sports equipment and/or tools as recited in claim 8, wherein said paint is industrial finish enamel flat paint.

10. A grip for sports equipment and/or tools as recited in claim 8, wherein said first gripping particles are powdery talc.

11. A grip for sports equipment and/or tools as recited in claim 10, wherein said second gripping particles are sand/quartz.

12. A grip for sports equipment and/or tools as recited in claim 10, wherein said second gripping particles are granular talc.

13. A grip for sports equipment and/or tools as recited in claim 7, wherein said sports equipment is a baseball bat comprising a knob at a first end of said bat opposite a ball hitting end of said bat, and further wherein said handle is located between said knob and said ball hitting end of said bat, said slurry of gripping material being applied to a circumferential area of said handle between said knob and a position along said handle toward said ball hitting end approximately 12 inches from said knob.

14. A grip for sports equipment and/or tools as recited in claim 13, wherein said bat is made of wood.

15. A grip for a handle of sports equipment and/or tools comprising:

a slurry of gripping material applied directly onto said handle of said sports equipment and/or said tool, comprising:

a quantity "a" of a binding fluid;

a quantity "b" of first gripping particles mixed into said binding fluid;

a quantity "c" of second gripping particles mixed into said binding fluid; and a quantity "d" of third gripping particles mixed into said binding fluid; wherein said quantities "b," "c" and "d" of said first, second and third gripping particles are in a fixed proportion to said quantity "a" of said binding fluid and to each other, wherein said quantity "b" of said first gripping particles is 38 ounces when said quantity "a" of said binding fluid is 1 gallon, said quantity "c" of said second gripping particles is ⅓ of a cup (or 2.7 ounces) and said quantity "d" of said third gripping particles is 6 ounces.

16. A grip for sports equipment and/or tools as recited in claim 15, wherein said binding fluid is paint.

17. A grip for sports equipment and/or tools as recited in claim 16, wherein said paint is industrial finish enamel flat paint.

18. A grip for sports equipment and/or tools as recited in claim 16, wherein said first gripping particles are powdery talc.

19. A grip for sports equipment and/or tools as recited in claim 18, wherein said second gripping particles are sand/quartz.

20. A grip for sports equipment and/or tools as recited in claim 19, wherein said third gripping particles are walnut shells.

21. A grip for sports equipment and/or tools as recited in claim 15, wherein said sports equipment is a baseball bat comprising a knob at a first end of said bat opposite a ball hitting end of said bat, and further wherein said handle is located between said knob and said ball hitting end of said bat, said slurry of gripping material being applied to a circumferential area of said handle between said knob and a position along said handle toward said ball hitting end approximately 12 inches from said knob.

22. A grip for sports equipment and/or tools as recited in claim 21, wherein said bat is made of wood.

23. A grip for a handle of sports equipment and/or tools comprising:

a slurry of gripping material applied directly onto said handle of said sports equipment and/or said tool, comprising:

a quantity "a" of a binding fluid;

a quantity "b" of first gripping particles mixed into said binding fluid;

a quantity "c" of second gripping particles mixed into said binding fluid;

a quantity "d" of third gripping particles mixed into said binding fluid; and a quantity "e" of fourth gripping particles mixed into said binding fluid; wherein said quantities "b," "c," "d" and "e" of said first, second, third and fourth gripping particles are in a fixed proportion to said quantity "a" of said binding fluid and to each other, wherein said quantity "b" of said first gripping particles is 37 ounces when said quantity "a" of said binding fluid is 1 gallon, said quantity "c" of said second gripping particles is ⅓ of a cup (or 2.7 ounces), said quantity "d" of said third gripping particles is 6 ounces and said quantity "e" of said fourth gripping particles is 1 ounce.

24. A grip for sports equipment and/or tools as recited in claim 23, wherein said binding fluid is paint.

25. A grip for sports equipment and/or tools as recited in claim 24, wherein said paint is industrial finish enamel flat paint.

26. A grip for sports equipment and/or tools as recited in claim 24, wherein said first gripping particles are powdery talc.

27. A grip for sports equipment and/or tools as recited in claim 26, wherein said second gripping particles are sand/quartz.

28. A grip for sports equipment and/or tools as recited in claim 27, wherein said third gripping particles are walnut shells.

29. A grip for sports equipment and/or tools as recited in claim 28, wherein said fourth gripping particles are sunflower seed shells.

30. A grip for sports equipment and/or tools as recited in claim 29, wherein said walnut shells and said sunflower seed shells are crushed.

31. A grip for sports equipment and/or tools as recited in claim 23, wherein said sports equipment is a baseball bat comprising a knob at a first end of said bat opposite a ball hitting end of said bat, and further wherein said handle is located between said knob and said ball hitting end of said bat, said slurry of gripping material being applied to a circumferential area of said handle between said knob and a position along said handle toward said ball hitting end approximately 12 inches from said knob.

32. A grip for sports equipment and/or tools as recited in claim 31, wherein said bat is made of wood.

33. A grip for a handle of sports equipment and/or tools comprising:

a slurry of gripping material applied directly onto said handle of said sports equipment and/or said tool, said slurry of gripping material having a substantially uniform thickness along an entire length of said handle, and comprising:

a quantity "a" of a binding fluid; and a quantity "b" of first gripping particles mixed into said binding fluid, wherein said quantity "b" of said first gripping particles is in a fixed proportion to said quantity "a" of said binding fluid, wherein said quantity "b" of said first gripping particles is 46.7 ounces when said quantity "a" of said binding fluid is 1 gallon.

34. A grip for sports equipment and/or tools as recited in claim 33, wherein said binding fluid is paint.

35. A grip for sports equipment and/or tools as recited in claim 34, wherein said paint is industrial finish enamel flat paint.

36. A grip for sports equipment and/or tools as recited in claim 34, wherein said first gripping particles are powdery talc.

37. A grip for sports equipment and/or tools as recited in claim 33, wherein said sports equipment is a baseball bat comprising a knob at a first end of said bat opposite a ball hitting end of said bat, and further wherein said handle is located between said knob and said ball hitting end of said bat, said slurry of gripping material being applied to a circumferential area of said handle between said knob and a position along said handle toward said ball hitting end approximately 12 inches from said knob.

38. A grip for sports equipment and/or tools as recited in claim 37, wherein said bat is made of wood.

39. A grip for a handle of sports equipment and/or tools comprising:

a slurry of gripping material applied directly onto said handle of said sports equipment and/or said tool, said slurry of gripping material forming a substantially uniform contact surface for gripping said sports equipment and/or said tools by at least one hand of a user thereof, said contact surface being comprised only of said slurry of gripping material, said slurry of gripping material, comprising:

a quantity "a" of a binding fluid; and a quantity "b" of first gripping particles mixed into said binding fluid, wherein said quantity "b" of said first gripping particles is in a fixed proportion to said quantity "a" of said binding fluid, wherein said quantity "b" of said first gripping particles is 46.7 ounces when said quantity "a" of said binding fluid is 1 gallon.

40. A grip for sports equipment and/or tools as recited in claim 39, wherein said binding fluid is paint.

41. A grip for sports equipment and/or tools as recited in claim 40, wherein said paint is industrial finish enamel flat paint.

42. A grip for sports equipment and/or tools as recited in claim 40 wherein said first gripping particles are powdery talc.

43. A grip for sports equipment and/or tools as recited in claim 39, wherein said sports equipment is a baseball bat comprising a knob at a first end of said bat opposite a ball hitting end of said bat, and further wherein said handle is located between said knob and said ball hitting end of said bat, said slurry of gripping material being applied to a circumferential area of said handle between said knob and a position along said handle toward said ball hitting end approximately 12 inches from said knob.

44. A grip for sports equipment and/or tools as recited in claim 43, wherein said bat is made of wood.

* * * * *